United States Patent [19]

Shibukawa

[11] 4,419,935

[45] Dec. 13, 1983

[54] EXPLOSIVE CHARGING APPARATUS FOR CHARGING EXPLOSIVE PELLETS TO A BORE IN A ROCK

[75] Inventor: Takao Shibukawa, Hiroshima, Japan

[73] Assignee: Toyo Kogyo Co., Ltd., Hiroshima, Japan

[21] Appl. No.: 456,507

[22] Filed: Jan. 7, 1983

[30] Foreign Application Priority Data

Jan. 9, 1982 [JP] Japan ..... 57-1626[U]

[51] Int. Cl.[3] ..... F42B 3/00

[52] U.S. Cl. ..... 102/313; 102/312; 86/20 C; 175/4.57; 299/13

[58] Field of Search ..... 102/312, 313; 86/20 C; 175/4.57, 4.58; 299/13

[56] References Cited

U.S. PATENT DOCUMENTS

| | | | |
|---|---|---|---|
| 3,180,221 | 4/1965 | Porter | 175/4.58 |
| 3,232,168 | 2/1966 | Mangeng et al. | 175/4.57 X |
| 3,721,471 | 3/1973 | Bergmann et al. | 102/313 X |
| 3,996,836 | 12/1976 | Lichtenberg | 86/20.15 |
| 4,040,355 | 8/1977 | Hopler, Jr. | 102/313 |
| 4,077,670 | 3/1978 | Spies et al. | 299/13 X |
| 4,088,368 | 5/1978 | Lavon et al. | 299/13 X |
| 4,289,354 | 9/1981 | Zakiewicz | 299/13 X |

FOREIGN PATENT DOCUMENTS

| | | | |
|---|---|---|---|
| 192134 | 4/1967 | U.S.S.R. | 86/20.15 |

*Primary Examiner*—Peter A. Nelson

*Attorney, Agent, or Firm*—Fleit, Jacobson, Cohn & Price

[57] ABSTRACT

An explosive charging apparatus for charging explosive pellets to a bore drilled in a rock. The apparatus includes a body having coaxial pellet guiding first and second bores, the second bore being provided with a pellet supplying port. A cylinder is provided and has a piston with its rod extending into the second bore to force the pellet therein when the rod is advanced under an air pressure supplied to the cylinder. The rod is formed with an axial air passage opened to the second bore and adapted to be connected with a pressurized air source when the rod is advanced so as to supply air pressure to the second bore to thereby drive the explosive pellet to the first bore. The first bore is supplied with a lower air pressure which functions to feed the pellet in the first bore to the bore in the rock. The cylinder is associated with a pilot operated valve which receives a returning pilot pressure when the piston is fully advanced and an advancing pilot pressure when the piston is fully retracted.

7 Claims, 5 Drawing Figures

EXPLOSIVE CHARGING APPARATUS FOR CHARGING EXPLOSIVE PELLETS TO A BORE IN A ROCK

The present invention relates to an explosive charging apparatus for charging an explosive into a bore drilled in a rock. More particularly, the present invention pertains to an explosive charging apparatus having charging pipe means adapted to be inserted into a bore drilled in a rock and means for advancing an explosive under pneumatic pressure through the charging pipe means.

In general, explosive pellets have been charged into a bore drilled in a rock through a manual operation using a pushing rod in case where the bore is of a small diameter and of a small length. Where the bore is oriented vertically, the explosive pellets may be charged thereinto under a gravity. For charging into a large diameter and long bore, use is made of a charging apparatus such as a pneumatic charging apparatus. Such explosive charging apparatus is effective to perform a high density charging which leads to a strong explosion. However, conventional pneumatic charging apparatus have been inconvenient in that high density charging has been disturbed when the rock bore is filled with water.

In Japanese patent application No. 53-48329 filed on Apr. 25, 1978 and disclosed for public inspection on Nov. 11, 1979 under the disclosure No. 54-140706, there is disclosed an explosive charging apparatus including means for supplying compressed air of relatively low pressure through a charging pipe continuously into the bore so as to displace the water in the bore to thereby make possible a high density charging. The proposed apparatus is also considered advantageous in that the compressed air supplied to the bore serves to compact the charged explosive pellets to increase the charging density. It should however be noted that the apparatus is complicated in structure and requires a number of parts.

It is therefore an object of the present invention to provide an explosive charging apparatus which is simple in structure but effective in operation.

Another object of the present invention is to provide an explosive charging apparatus in which number of parts can be decreased as compared with the known apparatus.

According to the present invention, the above and other objects can be accomplished by an explosive charging apparatus comprising charging pipe means adapted to be inserted into a bore drilled in a rock, body means connected to one end of said charging pipe means and having explosive guiding bore means extending axially in the body means so as to communicated at one end with said charging pipe means, said body means being formed with radially outwardly opening explosive supplying port means leading to an intermediate portion of said guiding bore means, cylinder means provided adjacent to the other end of said guiding bore means and having piston disposed in the cylinder means for reciprocating movement therein to and away from said guiding bore means, biasing means for urging said piston means away from the guiding bore means, rod means having one end connected with said piston means and the other end inserted into the guiding bore means so that said other end of the rod means is movable in response to a movement of said piston means between a retracted position wherein it is between the supplying port means and said other end of the guiding bore means and an advanced position wherein said other end of the rod means is advanced in the guiding bore means beyond said supplying port means whereby said supplying port means is opened to said guiding bore means when the rod means is in the retracted position to make it possible to supply an explosive to said guiding bore means but closed by said rod means when the rod means is in the advanced position, compressed air supply passage means formed in said body means and communicating with compressed air source means, air passage means formed in said rod means for connecting said compressed air supply passage means to said guiding bore means when said rod means is in the advanced position, valve means having a first position wherein said cylinder means is connected with the compressed air source means to move said piston means against said biasing means and a second position wherein said cylinder means is opened to atmosphere whereby the piston means is moved under said biasing means, said valve means being associated with first pilot means which is adapted to be connected with said compressed air supply passage means when said rod means is in the retracted position so as to shift said valve means from said second position to said first position and second pilot means which is adapted to be connected with said cylinder means to receive compressed air therefrom when said rod means is in the advanced position to shift the valve means from said first position to said second position.

According to the present invention, the piston means is provided with rod means for advancing the explosive which has been supplied from the supplying port means to the guiding bore means to a position where the explosive can further by advanced under the compressed air and the piston means is also operated under the compressed air, so that it is possible to utilize the compressed air effectively. The piston means is associated with biasing means for urging the piston means to retract the rod means associated therewith. Therefore, the piston means and the rod means can be retracted simply by opening the cylinder means to the atmosphere. With this arrangement, a simple, two-position valve can be used for the valve means.

It should further be noted that, in the structure of the aforementioned Japanese patent application, use is made of a swing type check valve in order to prevent back flow of explosive feeding air. According to the present invention, however, the air passage means formed in the rod means serves as a valve for controlling the explosive feeding air so that it is not required to use a check valve. Further, the aforementioned Japanese application proposes complicated arrangements comprised of limit valves and compressed air controlling sequence circuit for providing an automatic sequential control of the explosive charging operation. The present invention however simply uses the first and second pilot means in association with the valve means. Therefore, the structure of the present invention is significantly simplified as compared with the prior art.

The above and other objects and features of the present invention will become apparent from the following descriptions of a preferred embodiment taking reference to the accompanying drawings, in which.

Figure 1:
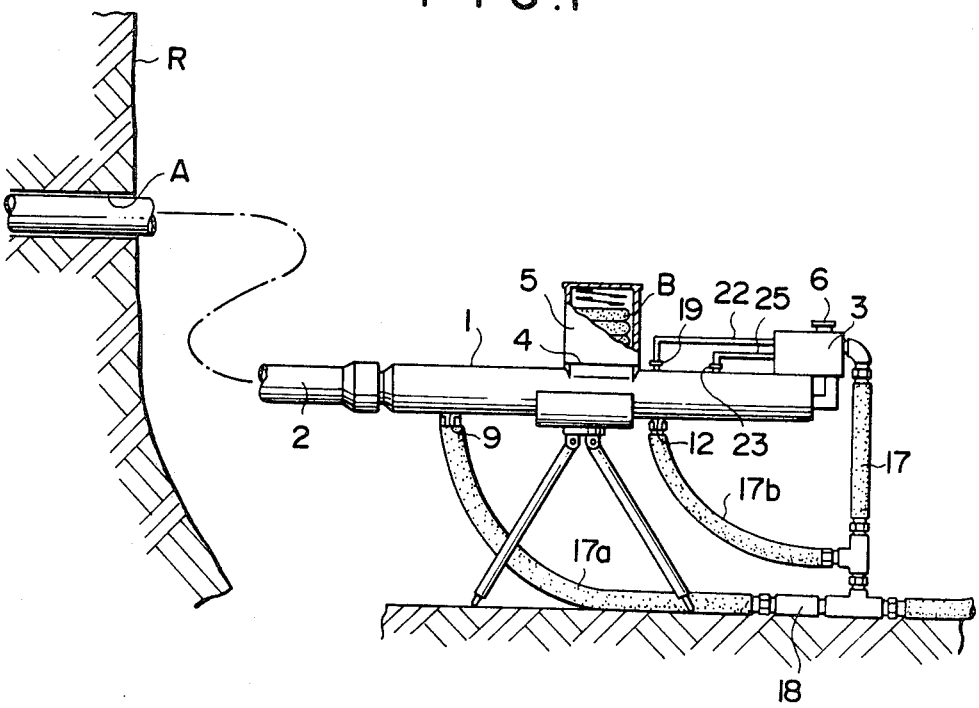
FIG. 1 is a side view of the explosive charging apparatus in accordance with one embodiment of the present invention.

Referring now to the drawings, particularly to FIG. 1, the explosive charging apparatus shown therein includes a body 1 having a forward end connected with a rear end of a charging pipe 2. At the rear end portion of the body 1, there is provided a pilot operated valve 3. The charging pipe 2 is inserted into a bore A drilled in the rock R as shown in FIG. 1. The body 1 is formed at an intermediate portion with an explosive supplying port 4 for charging an explosive pellet B to the body 1. An explosive magazine 5 is attached to the body 1 so that the explosive pellets B are supplied one by one to the port 4. The valve 3 is associated with a supply control valve 6 for controlling the supply of compressed air to the valve 3.

Figure 2:
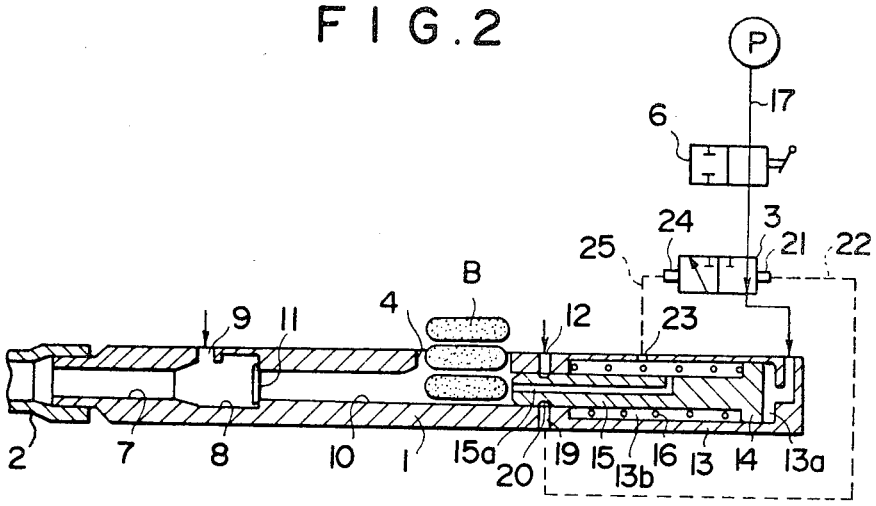
FIG. 2 is a sectional view of the apparatus shown in FIG. 1.

Referring now to FIG. 2, it will be noted that the body 1 is formed at the forward end portion thereof with a first pellet guiding bore 7 which extends from the forward end of the body 1 rearwardly for a certain distance. At the rear end of the first guiding bore 7, there is provided an enlarged feeding chamber 8 which has a first air supply port 9. The body 1 is further formed with a second guiding bore 10 which is coaxial with the bore 7 and extends rearwardly from the feeding chamber 8 beyond the explosive supplying port 4. At the junction between the feeding chamber 8 and the bore 10, there is provided a check valve 11 in order to prevent the compressed air in the chamber 8 from flowing into the bore 10. At the rear end portion, the body 1 is formed with a second air supplying port 12 which opens to the second explosive guiding bore 10 for supplying compressed air thereto.

Behind the second bore 10, the body 1 is formed with a cylinder 13 having a piston 14 which is slidable in the cylinder 13. The piston 14 has a forwardly extending rod 15 inserted into the second bore 10. The piston 14 divides the inside of the cylinder into two chambers 13*a* and 13*b*. In the chamber 13*b* which is adjacent to the bore 10, there is provided a biasing spring 16 for urging the piston away from the bore 10. The rod 15 is formed with an axially extending air passage 15*a* which opens at one end to the forward end of the rod 15 and at the other end to a periphery of the rod 15. The other end of the passage 15*a* is located so that it is communicated with the air supplying port 12 when the rod 15 is advanced by a predetermined distance.

The chamber 13*a* which is remote from the bore 10 is connected with the valve 3 which is in turn connected with the control valve 6 leading through an air pipe 17 to an air pump P. The valve 3 has a first position in which the chamber 13*a* is connected with the air pump P and a second position in which the chamber 13*a* is opened to the atmosphere. The air pipe 17 has a first and second branch pipes 17*a* and 17*b* which are respectively connected with the first and second air supplying ports 9 and 12. The branch pipe 17*a* is provided with a pressure reducing valve 18 for reducing the air pressure applied to the port 9.

At the same axial position as the air supplying port 12, the body 1 is formed with a first pilot port 19 and the rod 15 is formed with an annular groove 20 for connecting the ports 12 and 19 when the rod 15 is fully retracted. The valve 3 is provided with a first pilot valve 21 which is connected through a first pilot passage 22 with the first pilot port 19. When the pilot pressure is applied to the first pilot valve 21, it serves to move the valve 3 from the second position to the first position to thereby connect the chamber 13*a* to the air pump P.

The piston 14 is movable forwardly for a certain distance beyond the position wherein the passage 15*a* in the rod 15 is communicated with the second air supplying port 12 and the cylinder 13 is formed with a second pilot port 23 which is adapted to be opened to the chamber 13*a* when the piston 14 is advanced for a certain distance beyond the aforementioned position. The valve 3 is provided with a second pilot valve 24 which is connected through a pilot passage 25 to the pilot port 23. The pilot valve 24 serves to move the valve 3 from the first position to the second position when the pilot pressure is applied thereto through the pilot port 23 and the pilot passage 25 to thereby open the chamber 13*a* in the cylinder 13 to the atmosphere.

Figure 3:
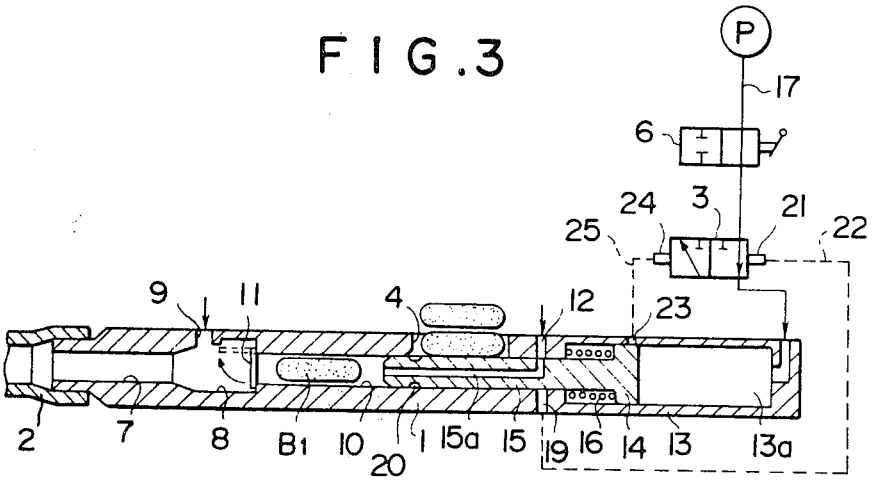
FIGS. 3 to 5 show sequential operations of the charging apparatus.
Figure 4:
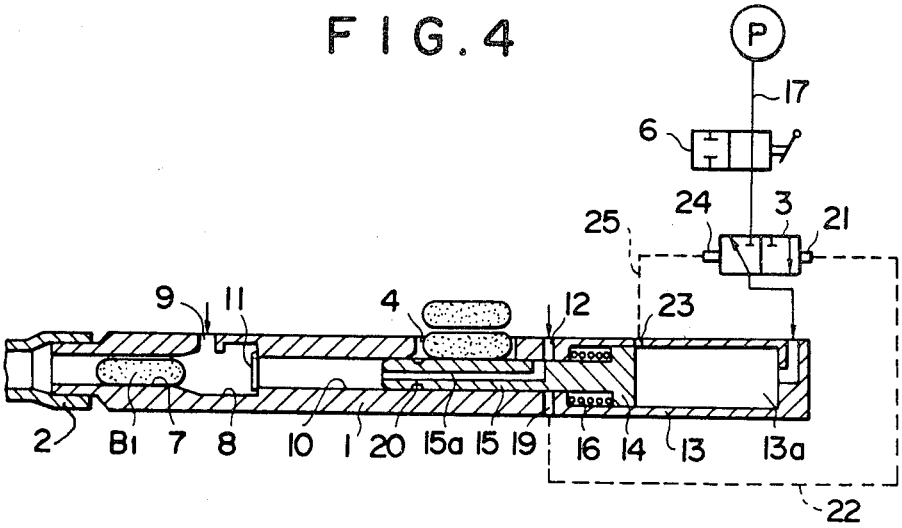
Figure 5:
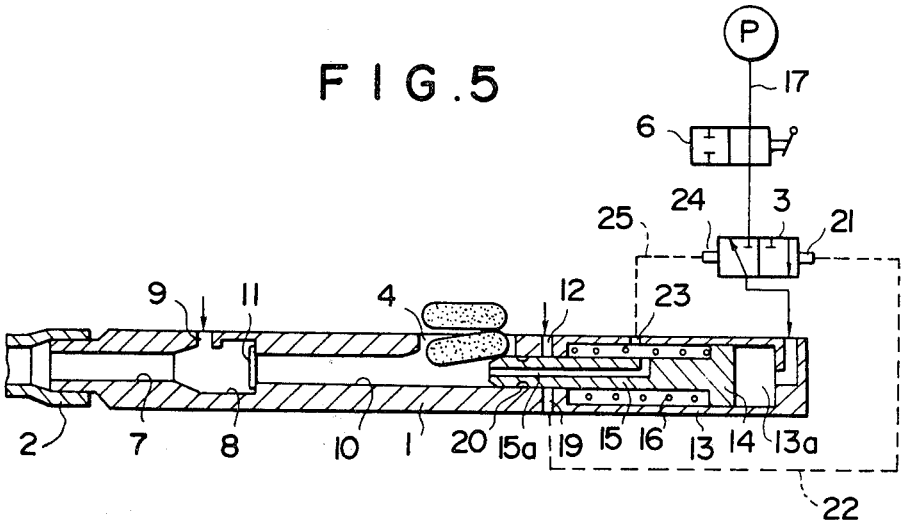

In operation, the explosive magazine 5 is mounted on the body 1 as shown in FIG. 1 and the air pump P is operated to supply the first air port 9 with the reduced air pressure through the pressure reducing valve and the second air port 12 with the high air pressure. At this time, the valve 3 is in the first position but the chamber 13*a* in the cylinder 13 is not supplied with air pressure because the valve 6 is closed. When the valve 6 is opened, the air pressure is applied to the chamber 13*a* so that the piston 14 is moved against the force of the spring 16 to thereby advance the rod 15 to the position shown in FIG. 3. Thus, the rod 15 forces the explosive pellet B which has been supplied to the bore 10 from the magazine 5 as shown by B1 in FIG. 3. In this position, the forward end of the rod 15 is advanced beyond the explosive supplying port 4 so that the rod 15 closes the port 4. Further, the air passage 15*a* in the rod 15 is communicated with the air pressure supplying port 12 so that the high air pressure is supplied to the bore 10 to force the explosive pellet B1 into the bore 7 as shown in FIG. 4.

The reduced air pressure which is supplied through the port 9 to the feeding chamber 8 functions to feed the pellet B1 through the charging pipe 2 to the bore A in rock R. Since only the reduced pressure is supplied to the feeding chamber 8, it is possible for the high air pressure supplied from the port 12 to drive the pellet from the bore 10 to the bore 7. In the position shown in FIG. 4, the pilot air port 23 is opened to the chamber 13*a* in the cylinder 13 so that the air pressure is applied through the pilot passage 25 to the pilot valve 24. Thus, the pilot valve 24 functions to move the valve 3 to the second position. The chamber 13*a* in the cylinder 13 is then opened to the atmosphere and the piston 14 and therefore the rod 15 is retracted under the force of the spring 16. When the rod 15 is sufficiently retracted, a second pellet of explosive is introduced into the bore 10 and, as the piston 14 returns to the position shown in FIG. 2. In the rod 15 is in the fully retracted position, the pilot air port 19 is communicated with the air pressure supplying port 12 through the annual groove 20 of the rod so that the air pressure is applied through the pilot passage 22 to the pilot valve 21. The pilot valve 21 functions to move the valve 3 to the first position as mentioned above the valve 3 is again shifted to the first position and a second cycle of operation is repeated.

If it is intended to have the apparatus automatically stopped after all of the explosive pellets in the magazine have been charged to the bore in the rock R, detecting means may be provided for detecting that the explosive magazine has been emptied for example by counting the number of operating strokes of the piston 14 to automatically close the valve 6. In the illustrated embodiment, the explosive pellet which has been advanced to the bore 7 is fed to the bore A in the rock R under the air pressure which is constantly applied to the chamber 8. It should however be noted that a time delay may be given to the returning stroke of the piston 14 for example by providing restriction orifice in the pilot passage 25 so that an adequate time is provided for feeding the explosive pellet through the charging pipe 2 to the rock bore A under the pressure supplied through the passage 15*a* in the rod 15.

The invention has thus been shown and described with reference to a specific embodiment, however, it should be noted that the invention is in no way limited to the details of the illustrated structures but changes and modifications may be made without departing from the scope of the appended claims.

I claim:

1. An explosive charging apparatus comprising charging pipe means adapted to be inserted into a bore drilled in a rock, body means connected to one end of said charging pipe means and having explosive guiding bore means extending axially in the body means so as to communicate at one end with said charging pipe means, said body means being formed with radially outwardly opening explosive supplying port means leading to an intermediate portion of said guiding bore means, cylinder means provided adjacent to the other end of said guiding bore means and having piston disposed in the cylinder means for reciprocating movement therein to and away from said guiding bore means, biasing means for urging said piston means away from the guiding bore means, rod means having one end connected with said piston means and the other end inserted into the guiding bore means so that said other end of the rod means is movable in response to a movement of said piston means between a retracted position wherein it is between the supplying port means and said other end of the guiding bore means and an advanced position wherein said other end of the rod means is advanced in the guiding bore means beyond said supplying port means whereby said supplying port means is opened to said guiding bore means when the rod means is in the retracted position to make it possible to supply an explosive to said guiding bore means but closed by said rod means when the rod means is in the advanced position, compressed air supply passage means formed in said body means and communicating with compressed air source means, air passage means formed in said rod means for connecting said compressed air supply passage means to said guiding bore means when said rod means is in the advanced position, valve means having a first position wherein said cylinder means is connected with the compressed air source means to move said piston means against said biasing means and a second position wherein said cylinder means is opened to atmosphere whereby the piston means is moved under said biasing means, said valve means being associated with first pilot means which is adapted to be connected with said compressed air supply passage means when said rod means is in the retracted position so as to shift said valve means from said second position to said first position and second pilot means which is adapted to be connected with said cylinder means to receive compressed air therefrom when said rod means is in the advanced position to shift the valve means from said first position to said second position.

2. An explosive charging apparatus in accordance with claim 1 in which said guiding bore means include a first guiding bore extending axially from said one end of said guiding bore means and a second guiding bore coaxial with said first guiding bore, check valve means provided between said first and second guiding bores for allowing air flow only from said second guiding bore to said first guiding bore, means being provided for supplying air pressure to said first guiding bore at an end portion adjacent to said second guiding bore, said second guiding bore being formed with said supplying port means, said rod means being inserted into said second guiding bore.

3. An explosive charging apparatus in accordance with claim 2 which further includes feed chamber means formed between said first and second guiding bores, said check valve means being provided between said chamber means and said second guiding bore means, said air pressure supplying means being opened to said feed chamber means.

4. An explosive charging apparatus in accordance with claim 2 in which said air pressure supplying means is provided with pressure reducing means so that the first guiding bore is supplied with air pressure which is lower than that supplied to the second guiding bore.

5. An explosive charging apparatus in accordance with claim 1 in which said rod means is formed with further passage means for connecting said first pilot means with said compressed air supply passage means in said retracted position of the rod means.

6. An explosive charging apparatus in accordance with claim 5 in which said further passage means is an annular groove formed in a surface area of said rod means.

7. An explosive charging apparatus in accordance with claim 1 in which said second pilot means includes a pilot port formed in said cylinder means at a position wherein it is opened to a pressure chamber of the cylinder means in the advanced position of the rod means.

* * * * *